US008939001B2

(12) United States Patent
Momo et al.

(10) Patent No.: US 8,939,001 B2
(45) Date of Patent: Jan. 27, 2015

(54) METHOD OF EXTRUSION FORMING

(75) Inventors: Yoichi Momo, Oyama (JP); Denjiro Kaneko, Oyama (JP)

(73) Assignee: Showa Denko K.K., Tokyo (JP)

( * ) Notice: Subject to any disclaimer, the term of this patent is extended or adjusted under 35 U.S.C. 154(b) by 542 days.

(21) Appl. No.: 13/265,136

(22) PCT Filed: Apr. 16, 2010

(86) PCT No.: PCT/JP2010/056836

§ 371 (c)(1),
(2), (4) Date: Dec. 9, 2011

(87) PCT Pub. No.: WO2010/122957

PCT Pub. Date: Oct. 28, 2010

(65) Prior Publication Data

US 2012/0079865 A1 Apr. 5, 2012

(30) Foreign Application Priority Data

Apr. 20, 2009 (JP) ..... 2009-101980

(51) Int. Cl.
*B21C 35/04* (2006.01)
*G03G 5/10* (2006.01)

(52) U.S. Cl.
CPC *B21C 35/04* (2013.01); *G03G 5/10* (2013.01); *G03G 5/102* (2013.01); *G03G 2215/00957* (2013.01)
USPC ..... 72/255; 72/256

(58) Field of Classification Search
CPC ..... B21C 35/02; B21C 35/023; B21C 35/04
USPC ..... 72/254–256, 257, 272
See application file for complete search history.

(56) References Cited

U.S. PATENT DOCUMENTS

| | | | | |
|---|---|---|---|---|
| 2,736,429 | A * | 2/1956 | Sejournet et al. | 72/257 |
| 4,056,964 | A * | 11/1977 | Shibasaki et al. | 72/273 |
| 4,231,245 | A * | 11/1980 | Ishiba | 72/273.5 |
| 4,793,170 | A | 12/1988 | Daniels | |
| 4,896,521 | A | 1/1990 | Sbrana | |
| 5,463,886 | A * | 11/1995 | Seitz | 72/12.2 |
| 5,832,767 | A | 11/1998 | Wompner et al. | |
| 5,836,190 | A | 11/1998 | Wompner et al. | |
| 2007/0227221 | A1 | 10/2007 | Yamamoto | |

FOREIGN PATENT DOCUMENTS

| | | | |
|---|---|---|---|
| CN | 1033585 | A | 7/1989 |
| CN | 201338027 | Y | 11/2009 |
| JP | 05-285532 | A | 11/1993 |
| JP | 2002-001422 | A | 1/2002 |

OTHER PUBLICATIONS

Official Communication issued in International Patent Application No. PCT/JP2010/056836, mailed on Jul. 13, 2010.

* cited by examiner

*Primary Examiner* — Debra Sullivan
(74) *Attorney, Agent, or Firm* — Keating & Bennett, LLP

(57) ABSTRACT

In an extrusion molding method, a discard 7 is pressed in the thickness direction with a stem 2 after releasing the restraint of the external peripheral surface of the discard 7 by the container 1 or while releasing the restraint to thereby reduce the thickness of the discard 7, and then the discard 7 is cut off with a shearing blade 4.

6 Claims, 5 Drawing Sheets

METHOD OF EXTRUSION FORMING

TECHNICAL FIELD

The present invention relates to an extrusion molding method including a step of shearing a discard of a billet, an extrusion molding device used for the extrusion molding method, and a production method of a raw tube for a photoconductive drum substrate.

In this specification, the terminology of "aluminum" is used to mean both pure aluminum and aluminum alloy unless otherwise specifically defined herein. Further, the terminologies of "upstream" and "downstream" denote "upstream" and "downstream" in the extrusion direction, respectively.

TECHNICAL BACKGROUND

An extruded member has been widely used as for example, a raw tube for a photoconductive drum substrate, a component for an office automation equipment, an architectural material, and an exterior member. In recent years, the demand for quality of a surface texture of an extruded member is getting stricter. Among other things, the demand for quality of appearance and surface roughness of an extruded member is especially getting stricter.

As appearance defects and surface roughness defects of an extruded member caused during extrusion molding, air entrapment defects can be exemplified. Such air entrapment defects not only cause appearance defects and surface roughness defects but also cause deterioration of an exterior appearance of a plastically formed product or an increased surface roughness when plastic forming, such as a drawing process or a bending process, is executed at the following step.

Furthermore, when a drawing process is executed at the following step, the air entrapment defects will be drawn in the drawing direction, which in turn causes enlarged ranges of the appearance defects and surface roughness defects. Especially, in the case of using a drawn member obtained through a drawing process as a raw tube for a photoconductive drum substrate, the surface roughness will be drawn in the axial direction of the raw tube, causing problems that elongated line-shaped defects will be appeared on a printed image.

As the causes for generation of air entrapment defects, a poor cut-surface of a discard can be exemplified. Considering it, a configuration of an extrusion die has been improved. For example, according to Japanese Unexamined Laid-open Patent Application Publication No. 2002-1422 (hereinafter referred to as "Patent Document 1"), it discloses forming of a concave portion in the center of the upstream end surface of the extrusion die (more specifically, porthole die) as the improvement of the configuration of the extrusion die. The discard is also called an extrusion remain which is apart of a billet remained in a container after extrusion.

PRIOR ART DOCUMENTS

Prior Art

Patent Document 1: Japanese Unexamined Laid-open Patent Application Publication No. 2002-1422

SUMMARY OF THE INVENTION

Problems to be Solved by the Invention

In the meantime, our inventor's research revealed that the status of a cut surface of a discard is strongly influenced by a thickness of the discard. In detail, as shown in FIG. 5(*a*), in cases where the discard 57 existing at the upstream side of the upstream end surface 53*a* of the extrusion die 53 is thick, in the middle of shearing the discard 57 with the shearing blade 54 along the upstream end surface 53*a* of the extrusion die 53 to remove the discard 57 as shown in FIGS. 5(*b*) and 5(*c*), the discard 57 is cut off from the extrusion die 53 together with a part 58 of the extruding material remained in the extrusion die 53. This causes a cavity "x" (dented portion) in the extrusion die 53. If the following extrusion step is resumed with a new billet (not illustrated) pressed against and pressure bonded to the remained extruding material in the extrusion die 53, the air in the cavity "x" will be entrapped into the extruding material 58, which results in a deteriorated external appearance and/or a deteriorated surface roughness.

The present invention was made in view of the aforementioned technical background, and aims to provide an extrusion molding method for producing an extruded member with a good external appearance and a small surface roughness, an extrusion molding device used for the extrusion molding method, and a production method of a raw tube for a photoconductive drum substrate.

Other objects and advantages of the present invention will be apparent from the following preferred embodiments.

Means for Solving the Problems

The present invention provided the following means.

[1] An extrusion molding method comprising:

a discard thickness reduction step for reducing a thickness of a discard by pressing the discard in a thickness direction of the discard with a stem after releasing restraint of an external peripheral surface of the discard by a container or while releasing the restraint; and a discard shearing step for shearing the discard with a shearing blade after the discard thickness reduction step.

[2] The extrusion molding method as recited in the aforementioned Item 1, further comprising:

a new billet press-bonding step for press-bonding a new billet mounted in the container to a remained extruding material in the extrusion die after the discard shearing step; and an extrusion molding resuming step for resuming extrusion molding after the new billet press-bonding step.

[3] The extrusion molding method as recited in the aforementioned Item 1 or 2, wherein the thickness of the discard is reduced so as to fall within a range of 10 to 30 mm at the discard thickness reduction step.

[4] The extrusion molding method as recited in any one of the aforementioned Items 1 to 3, wherein the extrusion molding method is an extrusion molding method of aluminum alloy, and wherein a temperature of the discard is within a range of 400 to 520° C. at the discard thickness reduction step.

[5] A production method of a raw tube for a photoconductive drum substrate characterized in that after executing the extrusion molding method as recited in any one of the aforementioned Items 1 to 4, an extruded tube obtained by the extrusion molding method is subjected to a drawing process.

[6] An extrusion molding device comprising:

a stem configured to press a billet arranged in a container; and a shearing blade configured to shear a discard of the billet, wherein the stem is configured to press the discard in a thickness direction of the discard so that a thickness of the discard is reduced after releasing a restraint of an external peripheral surface of the discard by the container or while releasing the restraint.

Effects of the Invention

The present invention exerts the following effects.

According to the invention [1], the reduction of the thickness of the discard tends to cause easy curling of the discard at the time of shearing the discard. The shearing of the discard to be performed thereafter causes no detachment of a part of the extruding material remained in the extrusion die, which prevents generation of voids in the extrusion die. As a result this causes no generation of external appearance defects and/or surface roughness defects of an extruded member, which enables production of an extruded member with an excellent external appearance and a small surface roughness.

According to the invention [2], an extruded member with an excellent external appearance and a small surface roughness can be assuredly produced.

According to the invention [3], an extruded member with an excellent external appearance and a small surface roughness can be assuredly produced.

According to the invention [4], an extruded member made of aluminum alloy with an excellent external appearance and a small surface roughness can be assuredly produced.

According to the invention [5], since the surface roughness of the extruded tube obtained by the extrusion molding method of the present invention is small, a raw tube for a photoconductive drum substrate with a mall surface roughness can be obtained by subjecting the extruded tube to a drawing process.

According to the invention [6], an extruding device preferably used for the extrusion molding method according to the present invention can be provided.

EMBODIMENTS FOR CARRYING OUT THE INVENTION

Next, an embodiment of the present invention will be explained with reference to drawings as follows.

Figure 1:
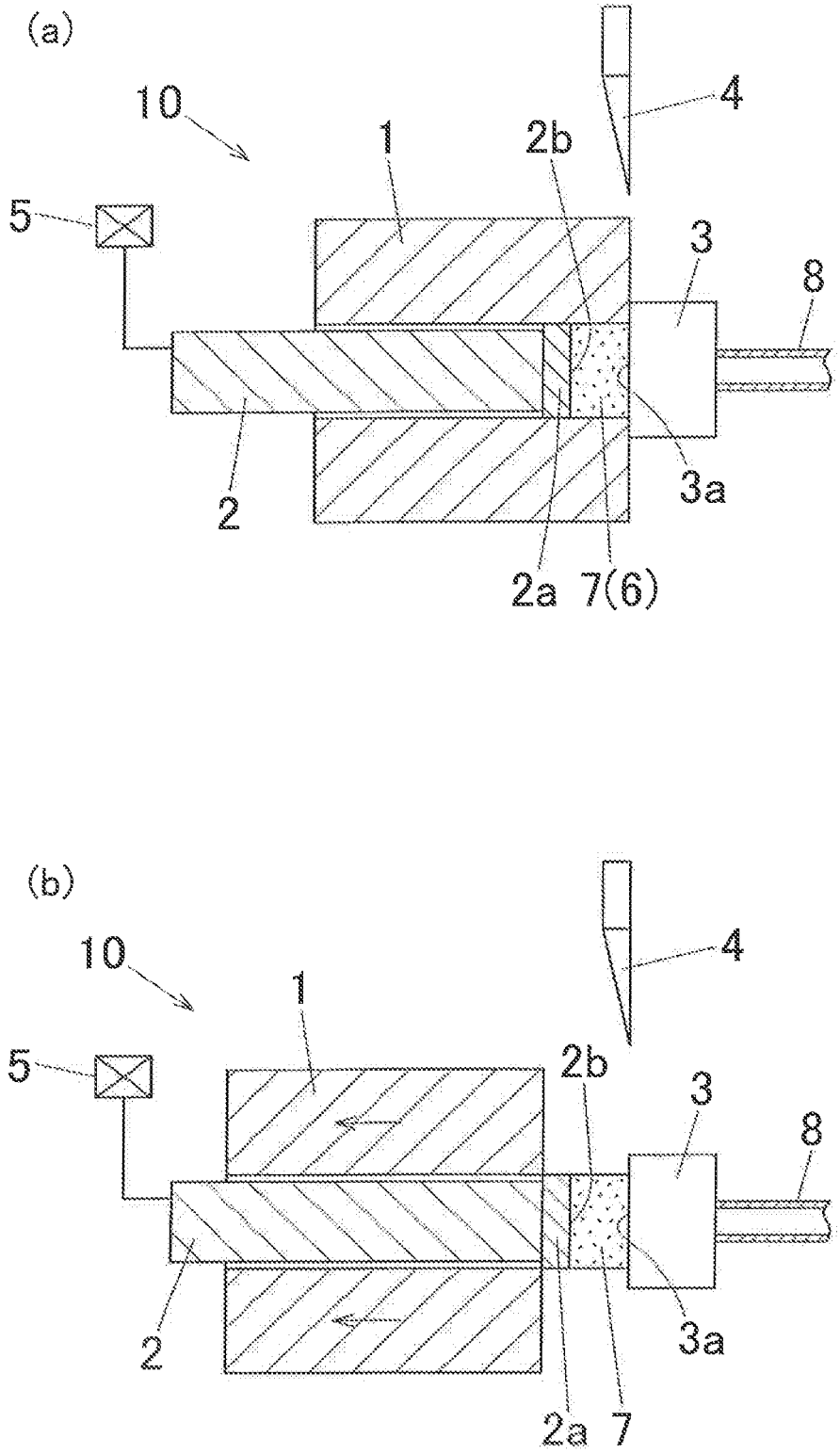
FIG. 1(*a*) is a schematic cross-sectional view showing a state in which a discard exists in a container according to an extrusion molding method of an embodiment of the present invention, and FIG. 1(*b*) is a schematic cross-sectional view showing a state in which the restraint of the external peripheral surface of the discard by the container is released.
Figure 2:
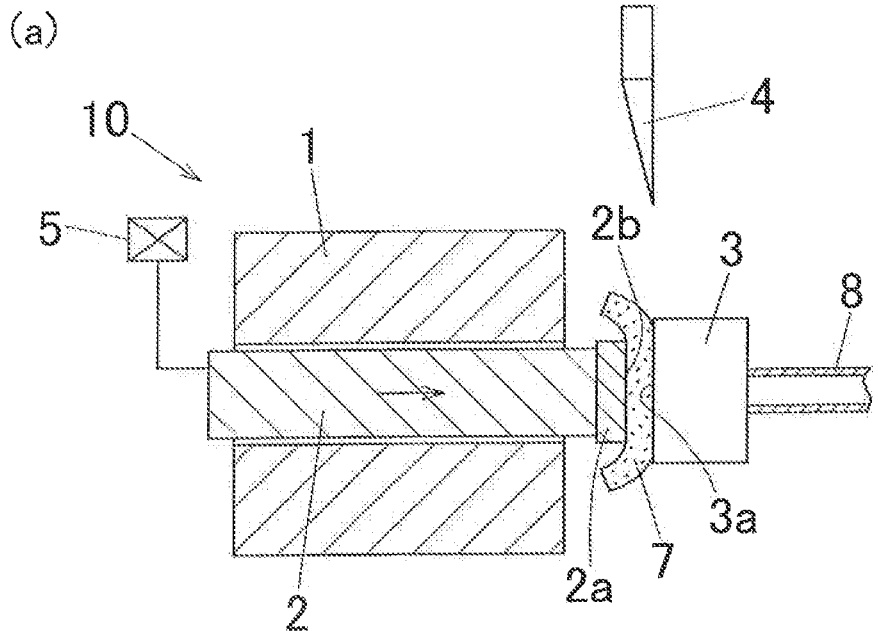
FIG. 2(*a*) is a schematic cross-sectional view showing a state in which a thickness of a billet was reduced by pressing the billet with a stem, and FIG. 2(*b*) is a schematic view showing a state immediately before shearing the discard with a shearing blade.
Figure 2:
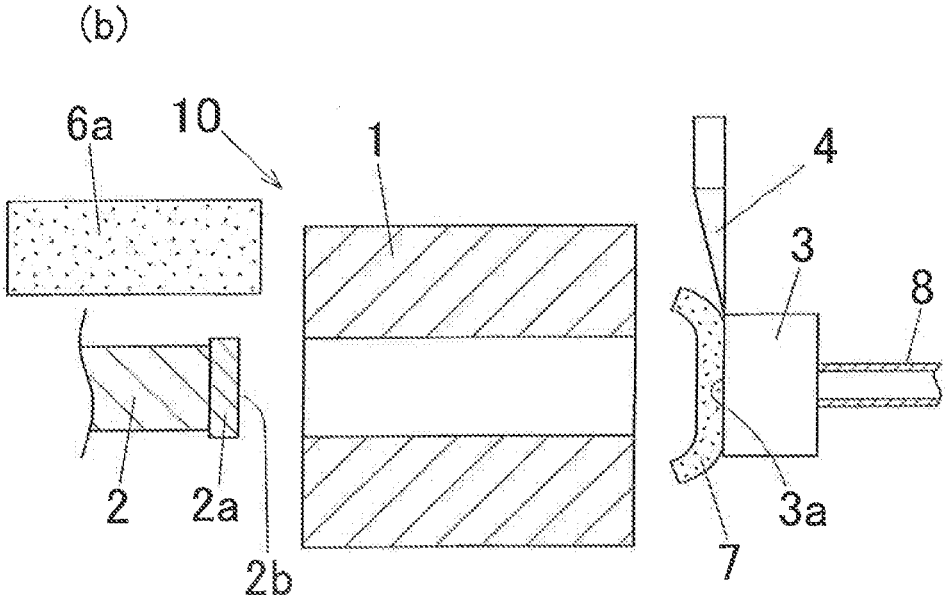
Figure 3:
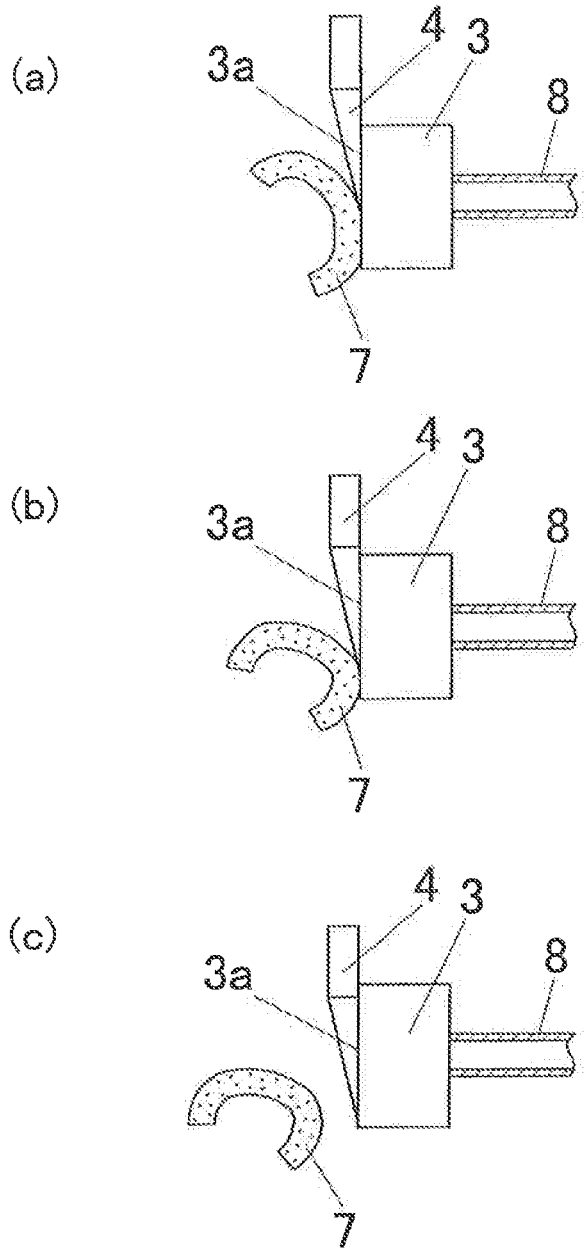
FIG. 3(*a*) is a schematic cross-sectional view showing a state in the middle of shearing the discard with the shearing blade, FIG. 3(*b*) is a schematic cross-sectional view showing a state immediately before completing the shearing of the discard, and FIG. 3(*c*) is a schematic view showing a state at the time of the completion of the shearing of the discard.

FIGS. 1 to 3 are drawings used to explain an extrusion molding method and an extrusion molding device according to an embodiment of the present invention. In FIG. 1, "10" denotes an extrusion molding device according to an embodiment of the present invention. More specifically, this extrusion molding device 10 is a direct extrusion molding device for producing a metal extruded member as an extruded member 8. The material of the extruded member 8 is metal, more specifically, aluminum. This extruded member 8 is a hollow extruded member (e.g., a pipe member) used as, for example, a raw tube for a photoconductive drum substrate, a component for an office automation equipment, an architectural material, and an exterior member, which has a hollow portion continuously extending in an extrusion direction. In this embodiment, the extruded member 8 is an extruded tube having a circular-ring cross-section. When the extruded member 8 is subjected to a drawing process, a raw tube for a photoconductive drum substrate can be obtained. The external peripheral surface of this raw tube will be coated by, e.g., an OPC (organic photo conductor) layer at the production step of a photoconductive dram substrate. Hereinafter, the extruded member 8 will be referred to as an extruded tube.

The extrusion molding device 10 is equipped with a container 1, a stem 2, an extrusion die 3, a shearing blade 4, etc.

The container 1 is configured to load an aluminum billet 6 therein. The container 1 has a function of guiding the billet 6 pressed by the stem 2 toward the extrusion die 3 and a function of restraining the external peripheral surface of the billet 6 so that the external peripheral surface of the billet 6 is not expanded in the radially outward direction when a pressing force from the stem 2 is applied to the billet 6. In these drawings, the billet 6 (and the discard 7) is shown with dotted hatching for an easy discrimination from other members.

The diameter and length of the billet 6 loaded in the container 1 is set depending on the diameter, thickness, and length of the extruded tube 8, and the diameter of the billet 6 is normally set to 155 to 205 mm and the length of the billet 6 is normally set to 300 to 790 mm, but not limited thereto.

The stem 2 is configured to press the billet 6 in the container 1. Connected to the basal end portion of the stem 2 is a driving device 5, such as, e.g., a hydraulic cylinder (e.g., oil hydraulic cylinder) which gives a pressing force to the stem 2. A dummy block 2*a* is provided at the tip end portion of the stem 2. This dummy block 2*a* is used to prevent the reverse flow of the billet material at the time of pressing the billet 6 with the stem 2.

The extrusion die 3 has, at its inner side, a molding hole (not illustrated), which is a through-hole, for molding the billet 6 into a predetermined cross-sectional shape. In this embodiment, the extrusion die 3 is used to produce the extruded tube 8, and can be, for example, a port-hole die. The upstream end surface 3*a* of the extrusion die 3 is a shearing reference plane along which the discard 7 of the billet 6 remained in the container 1 is sheared and removed (i.e., cut off).

The shearing blade 4 is configured to cut off the discard 7 along the upstream end surface 3*a* (i.e., the shearing reference plane) of the extrusion die 3. This shearing blade 4 is arranged sideways away from the position of the upstream end surface 3*a* of the extrusion die 3.

The stem 2 is configured to reduce the thickness of the discard 7 by pressing the discard 7 in the thickness direction (i.e., in the longitudinal direction of the billet 6) after releasing the restraint of the external peripheral surface of the discard 7 by the container 1 or while releasing the constraint.

Next, a method of performing extrusion molding of aluminum using the aforementioned extrusion molding device 10 will be explained below.

With an aluminum billet 6 loaded in the container 1 of the extrusion molding device 10, the stem 2 presses the billet 6 in the longitudinal direction to press the billet 6 into the extrusion die 3 to thereby produce an extruded tube 8 while molding the billet 6 into a predetermined cross-sectional shape. In a state in which the billet 6 is loaded in the container 1, the external peripheral surface of the billet 6 is restrained so as not to expand in the radially outward direction when the billet 6 receives a pressing force from the stem 2. In this embodiment, as mentioned above, since this extrusion molding device 10 is a direct extrusion molding device, and therefore the pressing direction of the billet 6 by the stem 2 coincides with an extrusion direction.

As shown in FIG. 1(*a*), when the length of the billet 6 remained in the container 1 has become a predetermined length, the pressing by the stem 2 is terminated. The billet 6 remained in the container 1 at this time becomes a discard 7 to be sheared, and the length of the remained billet 6 becomes a thickness of the discard 7. This discard 7 includes an entrapped impurity layer of the billet skin flowed rearward due to the container wall surface resistance generated during the extrusion molding. Therefore, the discard 7 contains a large amount of impurities. Although the thickness of the discard 7 is not limited to specific values, it is specifically preferable that the thickness of the discard 7 falls within the range of 20 to 60 mm. When the thickness of the discard 7 is not less than 20 mm (including 20 mm), it become possible to have the discard 7 assuredly contained the impurities. When the thickness of the discard 7 is not larger than 60 mm (including 60 mm), waist of the extruding material can be minimized.

Next, as shown in FIG. 1(*b*), the container 1 is retreated to thereby expose the discard 7 outside the container 1 through the downstream side outlet of the container 1. Thus, the restraint of the external peripheral surface of the discard 7 by the container will be released. This step is referred to as a "discard restraint releasing step." The discard 7 is integral with the remained extruding material in the extrusion die 3 with the discard 7 protruded from the upstream end surface 3*a* of the extrusion die 3 toward the upstream side.

Thereafter, as shown in FIG. 2(*a*), the discard 7 is pressed with the stem 2 in the thickness direction (in the extrusion direction in this embodiment) to thereby reduce the thickness of the discard 7. In other words, the discard 7 is caused to be plastically deformed so that the thickness is reduced. In accordance with the reduction of the thickness of the discard 7, the external peripheral surface of the discard 7 expands in the radially outward direction along the entire periphery, which increases the diameter of the discard 7. This step is referred to as a "discard thickness reduction step."

At the discard thickness reduction step, when the aluminum billet 6 is an aluminum alloy billet, i.e., the extrusion molding method is an extrusion molding method of aluminum alloy, the temperature of the discard 7 at the time of pressing the discard 7 with the stem 2 is preferably set to fall within the range of 400 to 520° C. If the temperature of the discard 7 is not larger than 520° C. (including 520° C.), the adhesion of the stem 2 and the discard 7 can be prevented assuredly. On the other hand, if the temperature of the discard 7 is too low, even if the stem 2 presses the discard 7, the thickness of the discard 7 will not be reduced sufficiently, which may cause such defects that impurities contained in the discard 7 are entrapped into the remained extruding material in the extrusion die 3. For this reason, it is preferable that the temperature of the discard 7 is set to fall within the range of 400 to 520° C. Especially, in cases where the aluminum billet 6 is aluminum alloy having an aluminum concentration of 90% or more (including 90%), the temperature of the discard 7 at the time of pressing the discard 7 with the stem 2 is preferably set to fall within the range of 420 to 490° C.

Furthermore, at the discard thickness reduction step, the discard 7 is preferably reduced in thickness so that the thickness falls within the range of 10 to 30 mm. When the thickness of the discard 7 is not less than 10 mm (including 10 mm), the discard 7 can be easily cut, and further it becomes possible to assuredly prevent the impurities contained in the discard 7 from being entrapped into the remained extrusion material in the extrusion die 3. When the thickness of the discard 7 is not larger than 30 mm (including 30 mm), the discard 7 will be curled assuredly at the time of shearing the discard 7 which in turn assuredly prevents the discard 7 from being cut off together with a part of the remained extrusion material in the extrusion die 3.

Next, as shown in FIG. 2(*b*), the stem 2 is retreated to terminate the pressing of the stem 2 against the discard 7, and the shearing blade 4 is advanced toward the upstream end surface 3*a* of the extrusion die 3 from the side.

As shown in FIG. 3(*a*) to FIG. 3(*c*), the shearing blade 4 is advanced along the upstream end surface 3*a* of the extrusion die 3 to thereby shear and remove (i.e., cut off) the discard 7 with the shearing blade 4 along the upstream end surface 3*a* of the extrusion die 3. At this time, since the thickness of the discard 7 has already been decreased, the discard 7 is in an easy-to-be-curled state. Therefore, as the shearing of the discard 7 with the shearing blade 4 is progressed, the discard 7 will be curled toward the upstream side. With this, at the time of shearing the discard 7, the discard 7 will not be cut off together with a part of the remained extruding material in the extruding die 3. Thus, the discard 7 will be cut off so that the cut surface of the remained extruding material in the extrusion die 3 becomes flat. This step is referred to as a "discard shearing step." In FIGS. 3(*a*) to 3(*c*), the container 1 and the stem 2 are not illustrated.

Next, although not illustrated, a new billet 6*a* (see FIG. 2(*b*)) is loaded in the container 1 and then the container 1 is returned to its initial position. Thereafter, the stem 2 is advanced to press the new billet 6*a* in its longitudinal direction (i.e., in the extrusion direction) to thereby press the new billet 6*a* against the remained extruding material in the extrusion die 3 to press-bond the new billet 6*a* to the remained extruding material. This step is referred to as a "new billet press-bonding step." Then, the extrusion molding is resumed. This step is referred to as an "extrusion molding resuming step."

According to the aforementioned extrusion molding method, since the thickness of the discard 7 has already been decreased at the discard shearing step, the discard 7 is in an easy-to-be-curled state. Therefore, the discard 7 can be sheared so that the cut surface of the remained extruding material in the extrusion die 3 becomes flat. With this, when a new billet 6*a* is press-bonded to the remained extruding material, no external appearance defects or surface roughness defects will be generated on a resultant extruded tube 8. Therefore, an extruded tube 8 with a good external appearance and a small surface roughness can be obtained.

By drawing the obtained extruded tube 8 with a publicly known drawing processing device (not illustrated), a raw tube for a photoconductive drum substrate can be obtained. This step is referred to as a "drawing processing step." Since this raw tube is obtained, by subjecting an extruded tube 8 having a smaller surface roughness to drawing processing, the surface roughness will be also small. Furthermore, since the surface roughness defect in the axial direction of the raw tube will not be drawn, no long and linear defect will be appeared on a printed image, which makes it possible to obtain an excellent printed image. Therefore, this raw tube can be preferably used as a photoconductive drum substrate.

Furthermore, in the extrusion molding device 10 according to this embodiment, the area of the pressing surface 2*b* of the stem 2 against the billet 6 is set to be smaller than an extrusion directional projected area of the discard 7 after the discard thickness reduction step. In this embodiment, the shape of the pressing surface 2*b* of the stem 2 is circular. The radius of the pressing surface 2*b* is set to be smaller than the minimum radius of the extrusion directional projected shape of the discard 7 after the discard thickness reduction step. With these settings, it becomes possible to assuredly curl the discard 7.

Further, in the aforementioned extrusion molding method, at the discard thickness reduction step, the processing heat generation caused by the plastic deformation of the discard 7 raises the temperature of the pressing surface 2*b* of the stem 2, and therefore the stem 2 and the discard 7 will become easily adhered with each other. To prevent this defect, a "lubricant adherence step" in which lubricant is adhered to at least a part of the pressing surface 2*b* of the stem 2 can be added before the discard thickness reduction step. By adding this lubricant adherence step, the adhesion between the stem 2 and the discard 7 at the discard thickness reduction step can be prevented assuredly. As the lubricant, a lubricating agent containing graphite or a lubricating agent containing boron nitride (BN) are preferably used. The adhering of the lubricant can be preferably performed by application or spray coating. As another method for preventing the adhesion between the stem 2 and the discard 7 at the discard thickness reduction step, a method of cooling the stem 2 to reduce the temperature can be employed. Employing both the cooling step of the stem 2 and the lubricant adhering step can more assuredly prevent the adhesion between the stem 2 and the discard 7.

Although an embodiment of the present invention was explained, the present invention is not limited to the embodiment, and can be modified variously.

Figure 4:
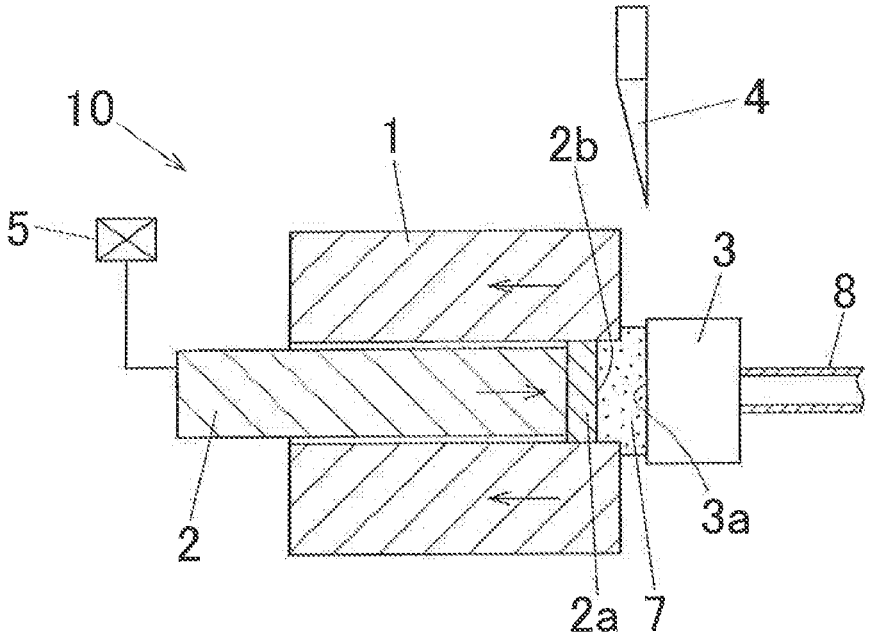
FIG. 4 is a schematic cross-sectional view showing a state in the middle of pressing the discard while releasing the restraint of the external peripheral surface of the discard by the container.
Figure 5:
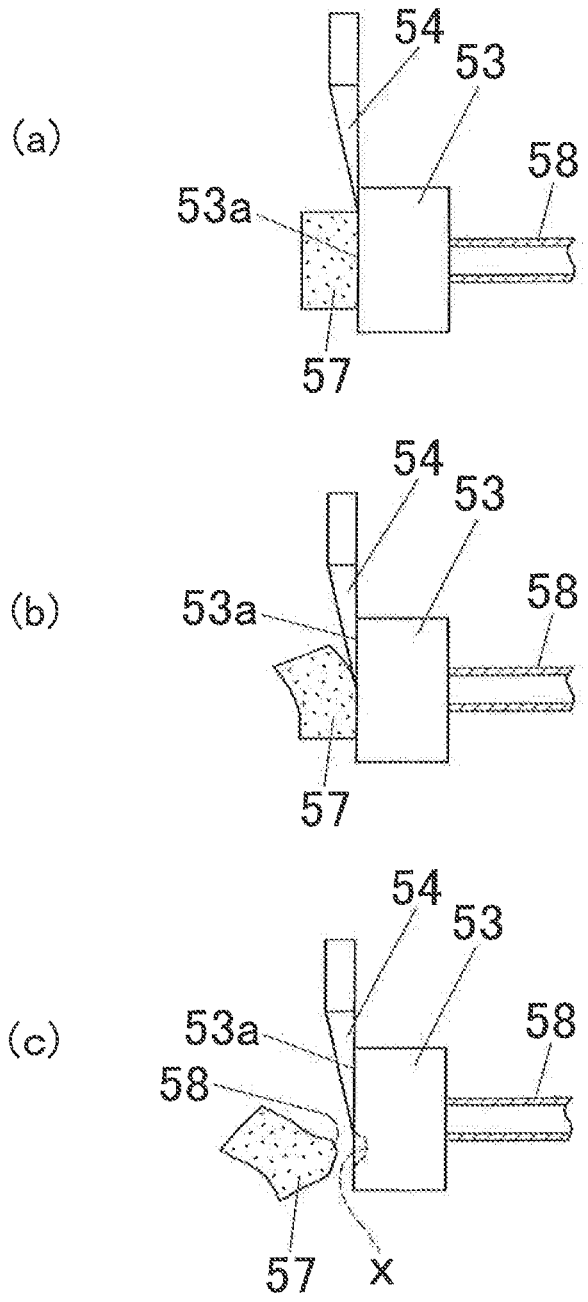
FIG. 5(*a*) is a schematic view showing a state immediately before shearing a discard with a shearing blade in a conventional extrusion molding method, FIG. 5(*b*) is a schematic view showing a state in the middle of shearing the discard, and FIG. 5(*c*) is a schematic view showing a state at the time of completion of the shearing of the discard.

For example, according to the aforementioned embodiment, at the discard thickness reduction step, after releasing the restraint of the external peripheral surface of the discard 7 by the container 1, the stem 2 presses the discard 7 in this thickness direction to thereby reduce the thickness of the discard 7. In the present invention, however, other than the above, as shown in FIG. 4, the thickness of the discard 7 can be reduced by pressing the discard 7 in the thickness direction with the stem 2 while releasing the restraint of the external peripheral surface of the discard 7 by the container 1. In FIG. 4, by advancing the stem 2 while retreating the container 1, the discard 7 is pressed in the thickness direction with the stem 2 while releasing the restraint of the external peripheral surface of the discard 7.

Furthermore, in the aforementioned embodiment, although the extrusion die 3 is a die designed to produce the extruded tube 8. In the present invention, however, other than the above, the extrusion die 3 can be a die for producing a solid extruded member. As an extrusion die 3 for producing a solid extruded member, a flat die or a flat die having a press-bonding plate can be exemplified.

Furthermore, in the aforementioned embodiment, although the extrusion molding device 10 is a direct extrusion molding device, in the present invention, the extrusion molding device can be an indirect extrusion molding device.

In the aforementioned embodiment, although a raw tube for a photoconductive drum substrate is obtained by drawing the extruded tube 8, in the present invention, such a raw tube for a photoconductive drum substrate can be obtained by cutting the external peripheral surface of the extruded tube 8. In this case, since the surface roughness of the extruded tube 8 is small, the cut processing depth can be small, resulting in good material yield.

This application claims priority to Japanese Patent Application No. 2009-101980 filed on Apr. 20, 2009, and the entire disclosure of which is incorporated herein by reference in its entirety.

It should be understood that the terms and expressions used herein are used for explanation and have no intention to be used to cons true in a limited manner, do not eliminate any equivalents of features shown and mentioned herein, and allow various modifications falling within the claimed scope of the present While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." in this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e. it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The present invention can be applicable to an extrusion molding method, an extrusion molding device, and a production method of a raw tube for a photoconductive drum substrate.

DESCRIPTION OF THE REFERENCE NUMERALS

1: container
2: stem
3: extrusion die
4: shearing blade
6: billet
7: discard
8: extruded tube (extruded member)
10: extrusion molding device

The invention claimed is:

1. A direct extrusion molding method comprising:

an extruding step for obtaining an extruded member by pressing a billet loaded in a container with a stem in an extrusion direction to press the billet against an extrusion die arranged at a downstream side of the container;

a discard thickness reduction step for reducing a thickness of a discard by pressing the discard between the stem and the extrusion die in a thickness direction of the discard to reduce the thickness of the discard by plastically deforming the discard with the stem after releasing restraint of an external peripheral surface of the discard by the container or while releasing the restraint; and a discard shearing step for shearing the discard with a shearing blade after the discard thickness reduction.

2. The direct extrusion molding method as recited in claim 1, further comprising:

a new billet press-bonding step for press-bonding a new billet mounted in the container to a remained extruding material in the extrusion die after the discard shearing step; and an extrusion molding resuming step for resuming extrusion molding after the new billet press-bonding step.

3. The direct extrusion molding method as recited in claim 1, wherein the thickness of the discard is reduced so as to fall within a range of 10 to 30 mm at the discard thickness reduction step.

4. The direct extrusion molding method as recited in claim 1, wherein the direct extrusion molding method is a direct extrusion molding method of aluminum alloy, and wherein a temperature of the discard is within a range of 400 to 520° C. at the discard thickness reduction step.

5. A production method of a raw tube for a photoconductive drum substrate characterized in that after executing the direct extrusion molding method as recited in claim 1, the extruded member obtained by the direct extrusion molding method is subjected to a drawing process to produce an extruded tube.

6. A direct extrusion molding device comprising:

a stem configured to press a billet arranged in a container in an extrusion direction;

a shearing blade configured to shear a discard of the billet, and an extrusion die arranged at a downstream side of the container, wherein the stem is configured to press the discard in a thickness direction of the discard between the stem and the extrusion die to plastically deform the discard so that a thickness of the discard is reduced after releasing a restraint of an external peripheral surface of the discard by the container or while releasing the restraint.

* * * * *